US006765345B1

(12) United States Patent
Mii

(10) Patent No.: US 6,765,345 B1
(45) Date of Patent: Jul. 20, 2004

(54) INERT GAS SUPPLEMENTING DEVICE FOR A FLUORESCENT LIGHT

(76) Inventor: Jenn-Wei Mii, 4F-9, No. 162, Sec. 4, Chunghsiao E. Rd., Taipei (TW)

( * ) Notice: Subject to any disclaimer, the term of this patent is extended or adjusted under 35 U.S.C. 154(b) by 0 days.

(21) Appl. No.: 10/375,302

(22) Filed: Feb. 27, 2003

(51) Int. Cl.[7] ..... H01J 1/62

(52) U.S. Cl. ..... 313/484; 313/562

(58) Field of Search ..... 313/484, 488, 313/545, 552, 562

(56) References Cited

U.S. PATENT DOCUMENTS 5,723,055 A * 3/1998 Janssen et al. ..... 222/603

* cited by examiner

*Primary Examiner*—Vip Patel
(74) *Attorney, Agent, or Firm*—Thomas, Kayden, Horstemeyer & Risley, LLP

(57) ABSTRACT

An inert gas supplementing device for a fluorescent light includes a tube having a closed end and an open end adapted to communicate with a light tube of the fluorescent light. A porous stop is received in the tube in an air-tight manner. An inert gas is received in an area enclosed by the closed end of the tube and the porous stop. The inert gas is able to seep through the porous stop and flow to the fluorescent light to supplement inert gas in the fluorescent light.

9 Claims, 9 Drawing Sheets

INERT GAS SUPPLEMENTING DEVICE FOR A FLUORESCENT LIGHT

BACKGROUND OF THE INVENTION

1. Field of the Invention

The present invention relates to an inert gas supplementing device, and more particularly to an inert gas supplementing device for a fluorescent light such that the life span of the fluorescent light is prolonged.

2. Description of Related Art

A conventional fluorescent light (80), as shown in FIG. 17, is filled with an inert gas so that when two electrodes (81) on opposite sides of the light tube is energized, the inert gas will glow.

With reference to FIG. 18, a process of producing the conventional fluorescent light (80) is shown, wherein after the light tube (not numbered) which has two electrodes formed on opposite ends thereof is vacuum by a proper tool and filled with a certain inert gas with a certain quantity, both ends of the light tube are sealed to enclose the inert gas inside the light tube. However, after a long period of time repeatedly energizing the inert gas, the quantity of the inert gas inside the light tube is gradually decreased due to the sputtering effect inside the light tube. When the quantity of the inert gas inside the light tube is decreased to cause the pressure of the inert gas inside the light tube to be below the standardized pressure, the luminosity of the fluorescent light is dimmed and it is time to replace the light tube.

Furthermore, because most of the light tubes are made of glass and some of the gases in the light tubes are poisonous, when replacing the light tube that is out of order, special precaution should be taken into consideration to avoid contamination to the environment.

To overcome the shortcomings, the present invention tends to provide an inert gas supplementing device to mitigate and obviate the aforementioned problems.

SUMMARY OF THE INVENTION

The primary objective of the present invention is to provide an inert gas supplementing device for a fluorescent light so that the life span of the fluorescent light is prolonged after the inert gas supplementing device supplements the gas to the light tube.

Another objective of the present invention is to provide a heating device on the inert gas supplementing device to increase the supplementing process of the inert gas to the fluorescent light.

Other objects, advantages and novel features of the invention will become more apparent from the following detailed description when taken in conjunction with the accompanying drawings.

DETAILED DESCRIPTION OF THE PREFERRED EMBODIMENT

Figure 1:
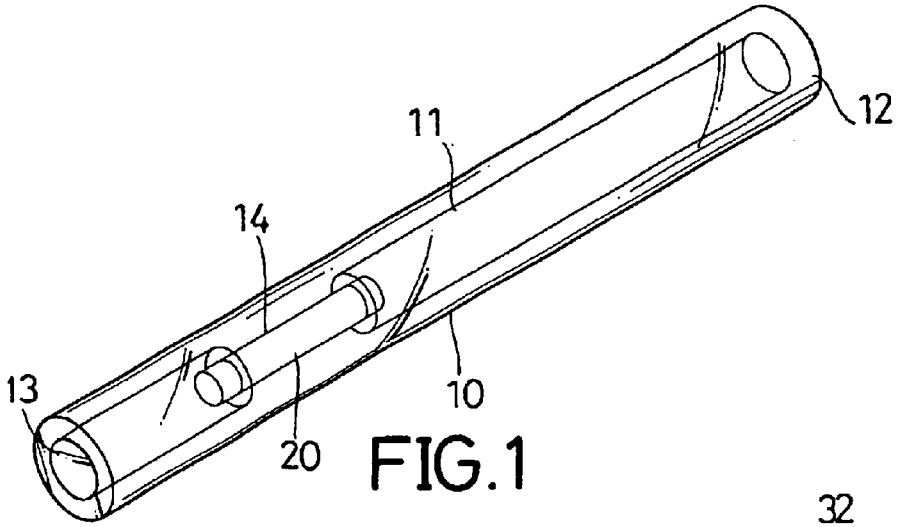
FIG. 1 is a perspective view of the first preferred embodiment of the present invention.
Figure 2:
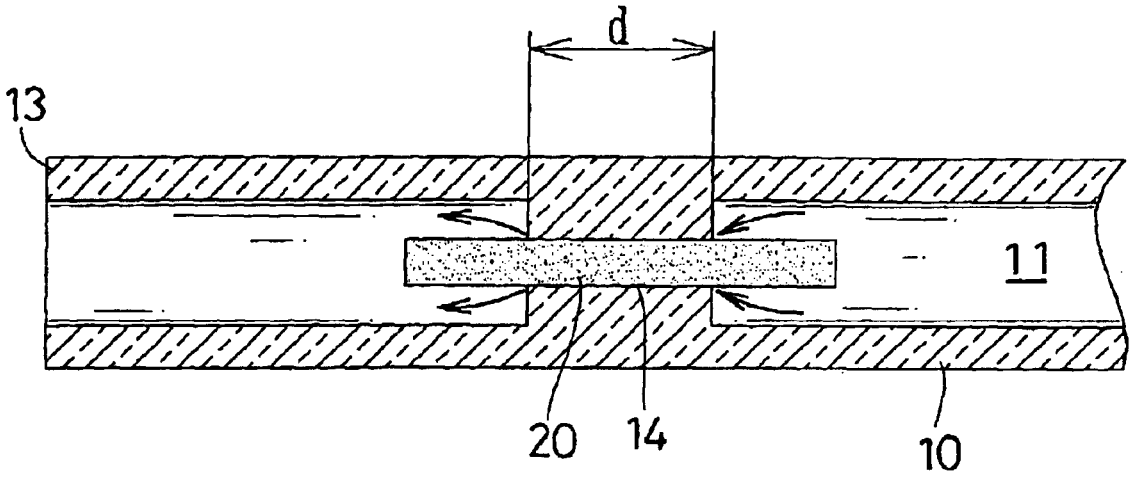
FIG. 2 is a cross sectional view of the first preferred embodiment of the present invention.

With reference to FIGS. 1 and 2, the inert gas supplementing device in accordance with the present invention includes a tube (10) defining therein a space (11) and provided with a first end (12) and a second end (13).

A shoulder (14) is formed inside the tube (10) and a porous stop (20) is received in the shoulder (14) in the tube (10). The porous stop (20) has a length longer than that of the shoulder (14) such that two distal ends of the porous stop (20) respectively extend to different portions in the space (11).

The porous stop (20) has a heat expansion coefficient the same as that of the tube (10) and is able to securely combine with the tube (10) so that even after the porous stop (20) is heated, separation between the tube (10) and the porous stop (20) is avoided.

When the inert gas supplementing device of the present invention is in use, the tube (10) is filled with a chosen inert gas. Then the first end (12) of the tube (10) is sealed and the second end (13) is connected to and communicates with a fluorescent light tube (not shown). After the assembly of the inert gas supplementing device of the present invention with the fluorescent light is finished, the inert gas in the tube (10) seeps through the porous stop (20) from the first end (12) and flows to the second end (13) which communicates with the fluorescent light. Because the pressure in the tube (10) is about one atmosphere (1atm) and the fluorescent light tube is in vacuum, the inert gas flowing to the second end (13) will flow into the fluorescent light, which supplements the inert gas which has decreased in the fluorescent light. It is noted that the shoulder (14) has a length (d) and the inert gas in the first end (12) will have to pass through the entire distance of the length (d) to reach the second end (13) so that adjusting the length (d) is able to adjust the inert gas seeping speed.

Figure 3:
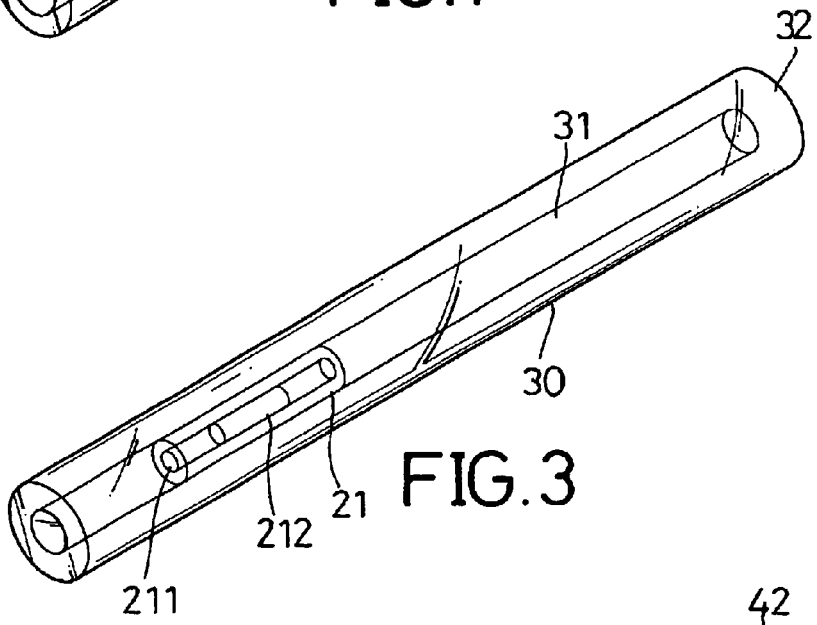
FIG. 3 is a perspective view of the second preferred embodiment of the present invention.
Figure 4:
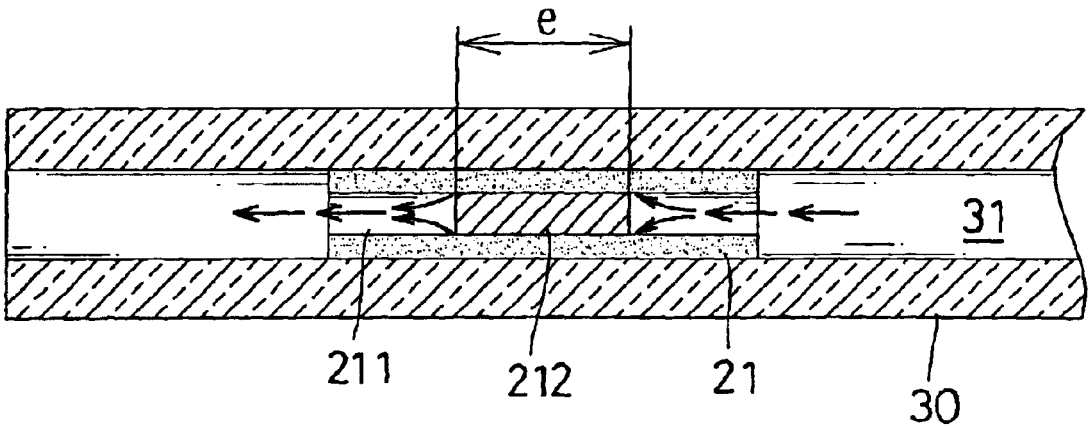
FIG. 4 is a cross sectional view of the second preferred embodiment of the present invention.

With reference to FIGS. 3 and 4, the tube is now designated with a reference numeral 30 and the porous stop is now designated with a reference numeral 21. The porous stop (21) is received in the space (31) of the tube (30) and has a passage (211) defined through the porous stop (21) to receive therein a stop (212). After the space (31) of the tube (30) is filled with a chosen inert gas, the first end (32) of the tube (30) is sealed and the second end (33) of the tube (30)

is connected to and communicates with the fluorescent light (not shown). Because the fluorescent light is in vacuum and the pressure inside the tube (30) is about one atmosphere, after the first end (32) is sealed, the inert gas inside the tube (30) start seeping through a portion of the porous stop (21) that is covered by the stop (212). It is noted from the drawing that the stop (212) has a length (e) such that adjusting the length of the stop (212) is able to adjust the seeping speed of the inert gas from the first end (32) to the second end (33) of the tube (30) and then to the fluorescent tube.

Figure 5:
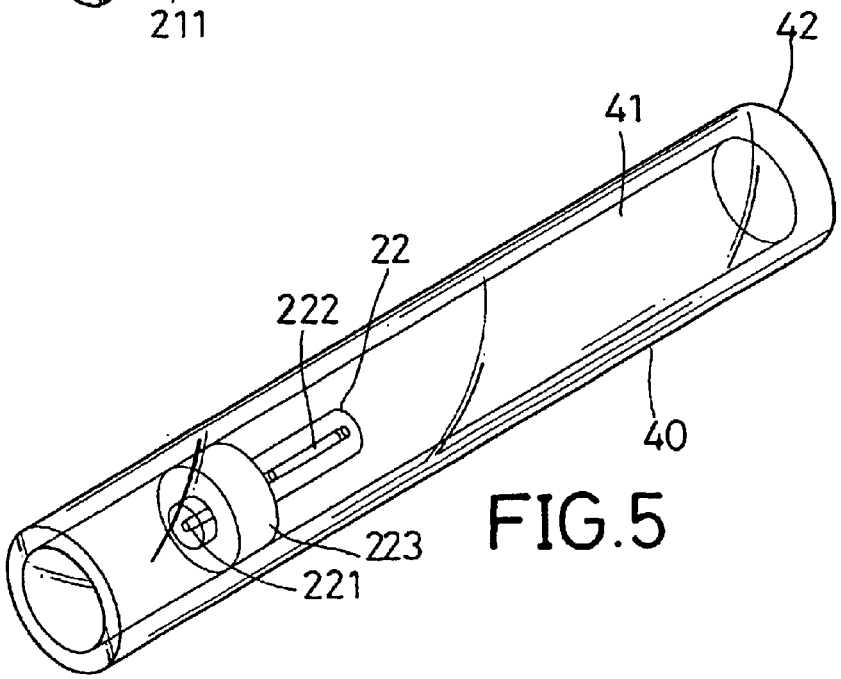
FIG. 5 is a perspective view of the third preferred embodiment of the present invention.
Figure 6:
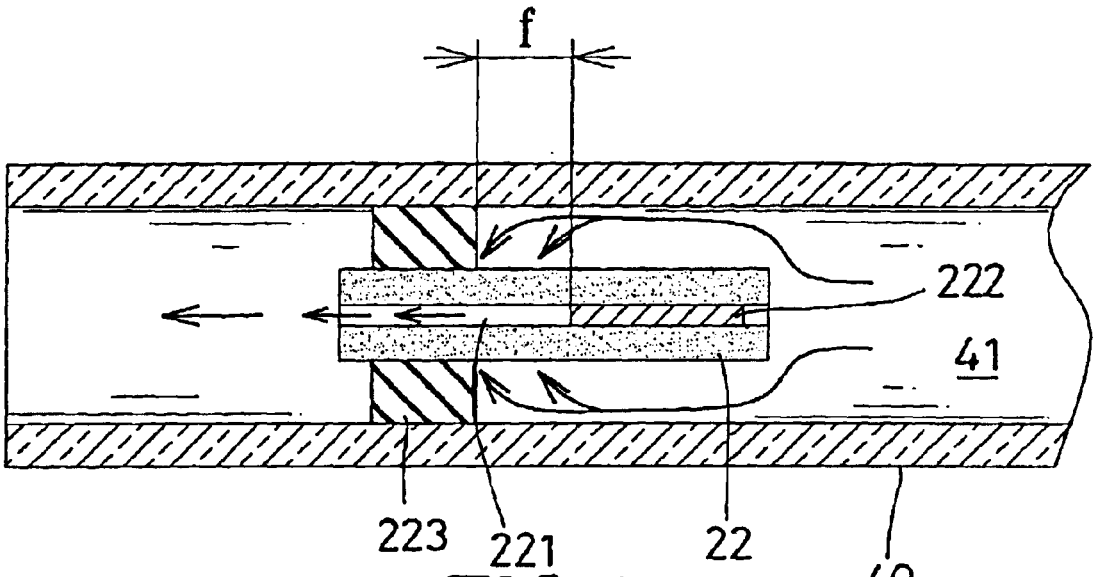
FIG. 6 is a cross sectional view of the third preferred embodiment of the present invention.

With reference to FIGS. 5 and 6, the tube (40) provided with a space (41) has a first end (42) and a second end (43). A porous stop (22) is received in the space (41) and close to the second end (43). The porous stop (22) has a passage (221) defined through the porous stop (22) to receive therein a stop (222). A plug (223) is securely mounted around an outer periphery of the porous stop (22) and engages with an inner periphery of the tube (40). Thus a distance (f) is defined between the plug (223) and the stop (222), through which the inert gas in the first end (42) of the tube (40) communicates with the fluorescent light. Therefore, it may be concluded that adjusting the distance (f) is able to adjust the seeping speed of the inert gas to the fluorescent light.

Figure 7:
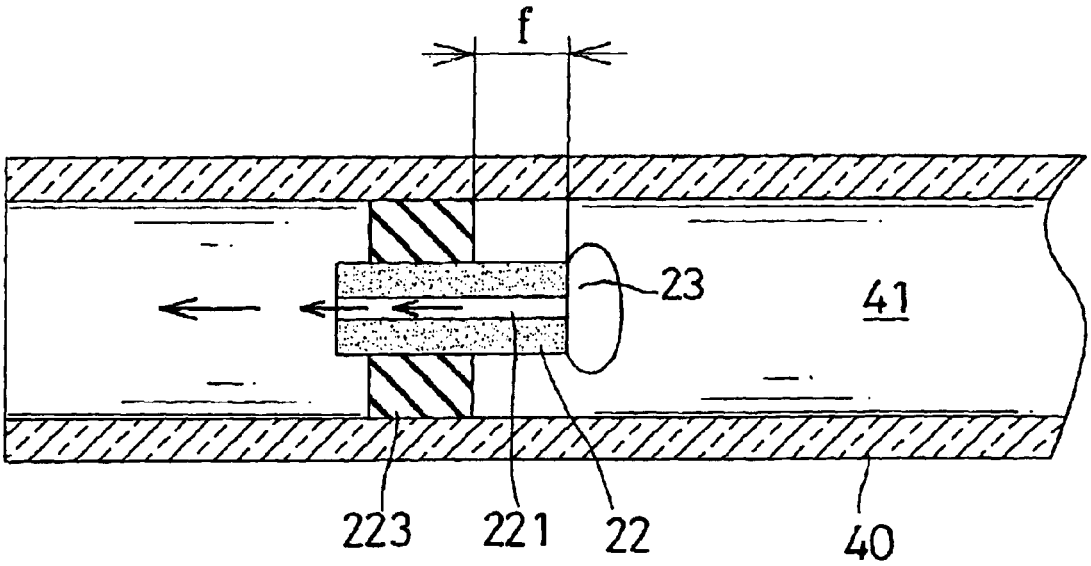
FIG. 7 is a schematic view showing another embodiment of the third preferred embodiment in FIG. 5.

With reference to FIG. 7, it is noted that the tube (40) is provided with a space (41) inside the tube (40) to receive therein a porous stop (22). The porous stop (22) has a passage (221) defined through the porous stop (22). A plug (223) is securely mounted around an outer periphery of the porous stop (22) and engages with an inner periphery of the tube (40). A seal (23) is then provided to close one end of the passage (221) so that a distance is defined between the plug (223) and the seal (23). Therefore, it may also be concluded that the adjusting the distance (f) is able to adjust the seeping speed of the inert gas to the fluorescent light.

Figure 8:
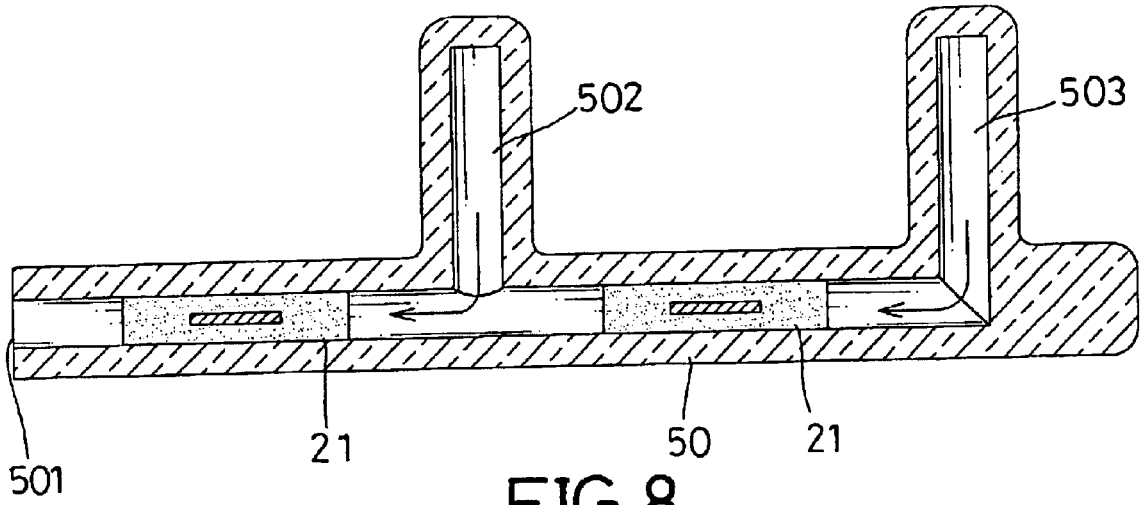
FIGS. 8 to 10 are schematic views showing combination of two tubes.

With reference to FIG. 8, it is noted that the tube (50) has a closed end, and an open end (501) which communicates with the fluorescent light. A first and second porous stop (21) are spatially received in the tube (50) so as to define two spaces (502,503) to receive therein inert gas. It is noted that the inert gas in the space (503) seeps through the first porous stop (21) and then flows to the space (502). Then the inert gas in the space (502) seeps through the second porous stop (21) and flows to the fluorescent light from the open end (501).

Figure 9:
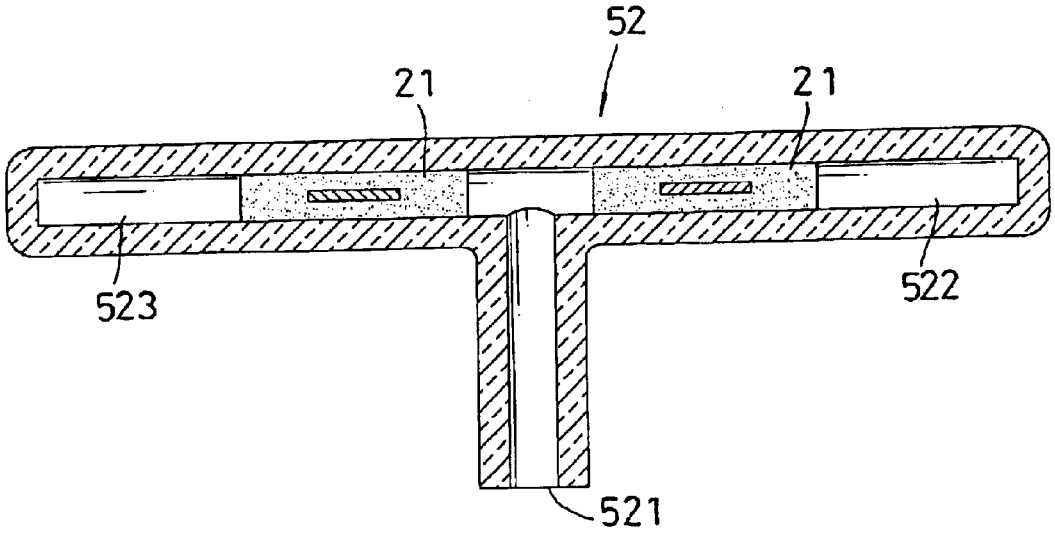

With reference to FIG. 9, a T-shaped tube (52) is used and is provided with a transverse portion and a perpendicular portion. The perpendicular portion has an open end communicating with the fluorescent light and a second end communicating with the transverse portion. The transverse portion has two porous stops (21) spatially received in the transverse portion so that two spaces (522,523) are respectively defined in opposite ends of the transverse portion. Therefore, the inert gas in the spaces (522,523) is able to seep through the respective porous stops (21) to flow to the perpendicular portion and thus to the fluorescent light.

Figure 10:
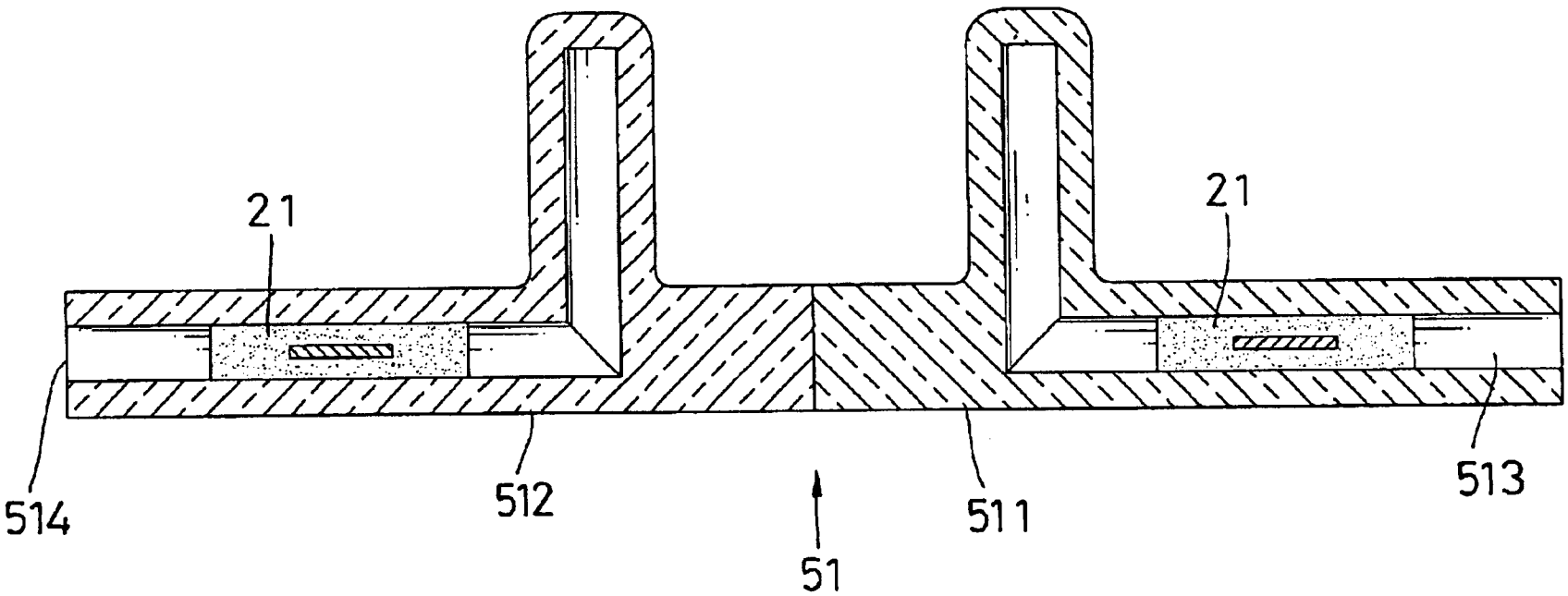
Figure 11:
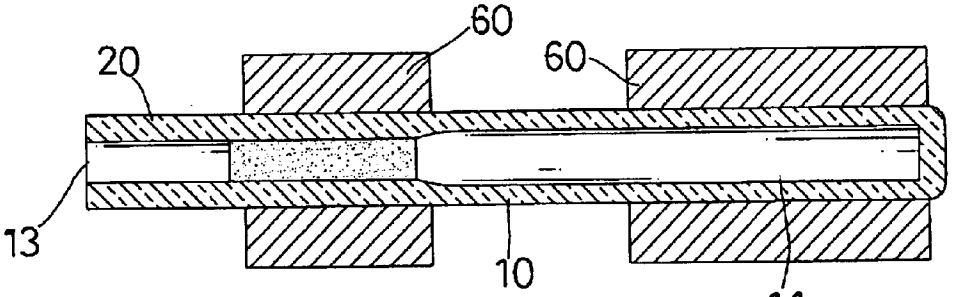
FIGS. 11 to 14 are schematic views showing that a heating device is added to the tubes of different embodiments of the present invention.

With reference to FIG. 10, two tubes (511) are integrally formed to respectively have a closed end and an open end (513,514). Each of the tubes (511 ) has a porous stop (21) so that the inert gas in the tubes (511) is able to respectively seep through the porous stop (21) and then flow to the open end (513,514) to enter the fluorescent light to supplement the inert gas in the fluorescent light.

With reference to FIGS. 11 to 14, it is noted that a heating device (60) such as a winding core made of tungsten is mounted around the tube (10) to simultaneously or individually increase the pressure of the inert gas or the dimension of the voids of the porous stop (20). Therefore, when the decreasing speed of the inert gas in the fluorescent light does not match to the seeping velocity of the inert gas in the tube (10), the heating device (60) is able to accelerate the seeping velocity of the inert gas to the fluorescent light.

Figure 12:
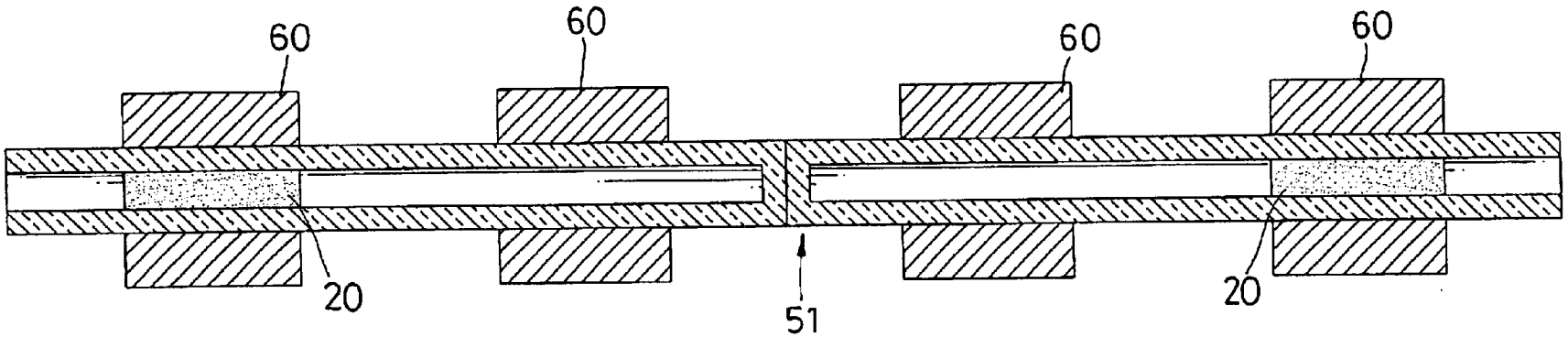
Figure 14:
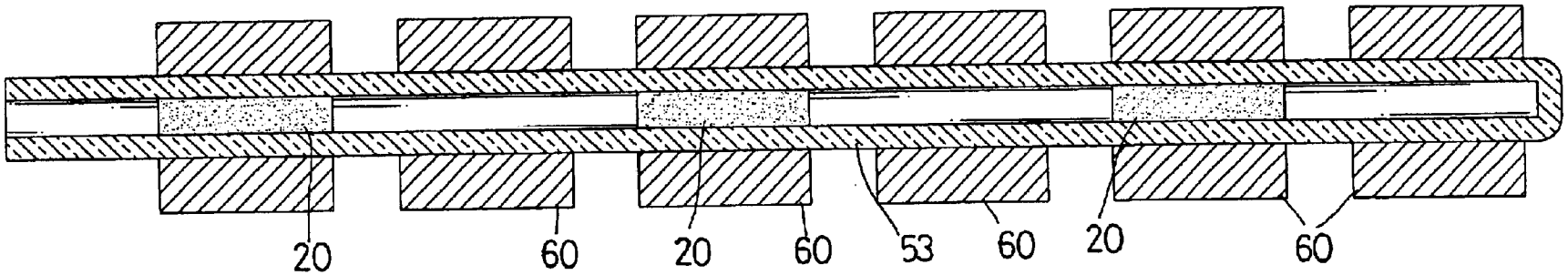
Figure 13:
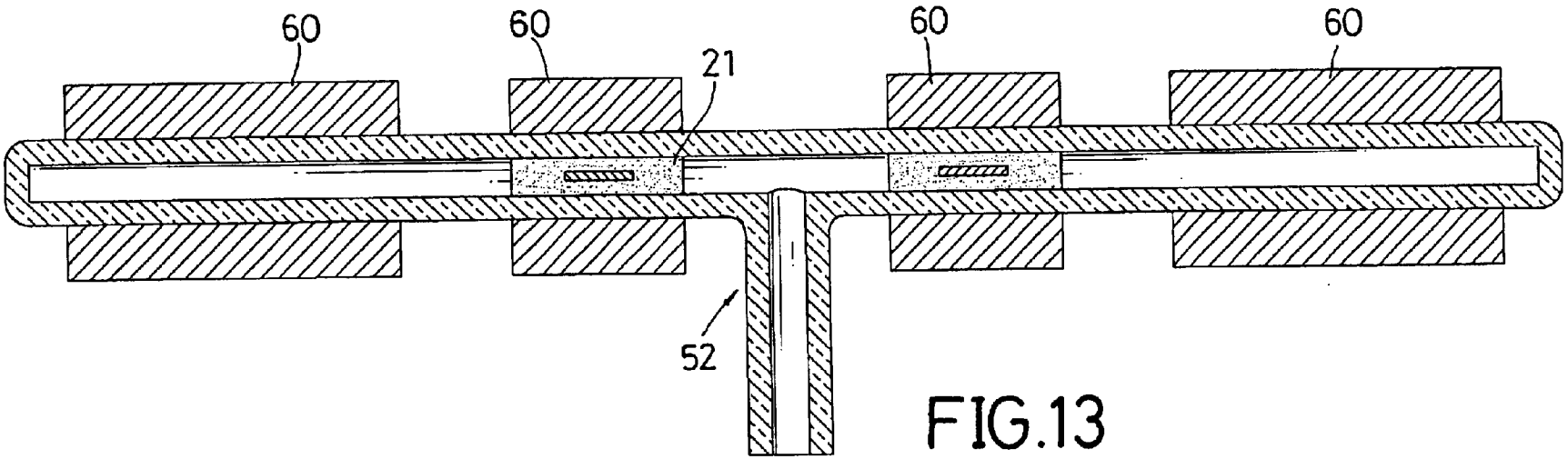

The embodiments in FIGS. 12, 13 and 14 display that the heating devices are added to different tubes (51,52,53) to simultaneously or individually increase the pressure of the inert gas in the tubes (51,52,53) and the dimension of the void of the porous stop (20).

Figure 15:
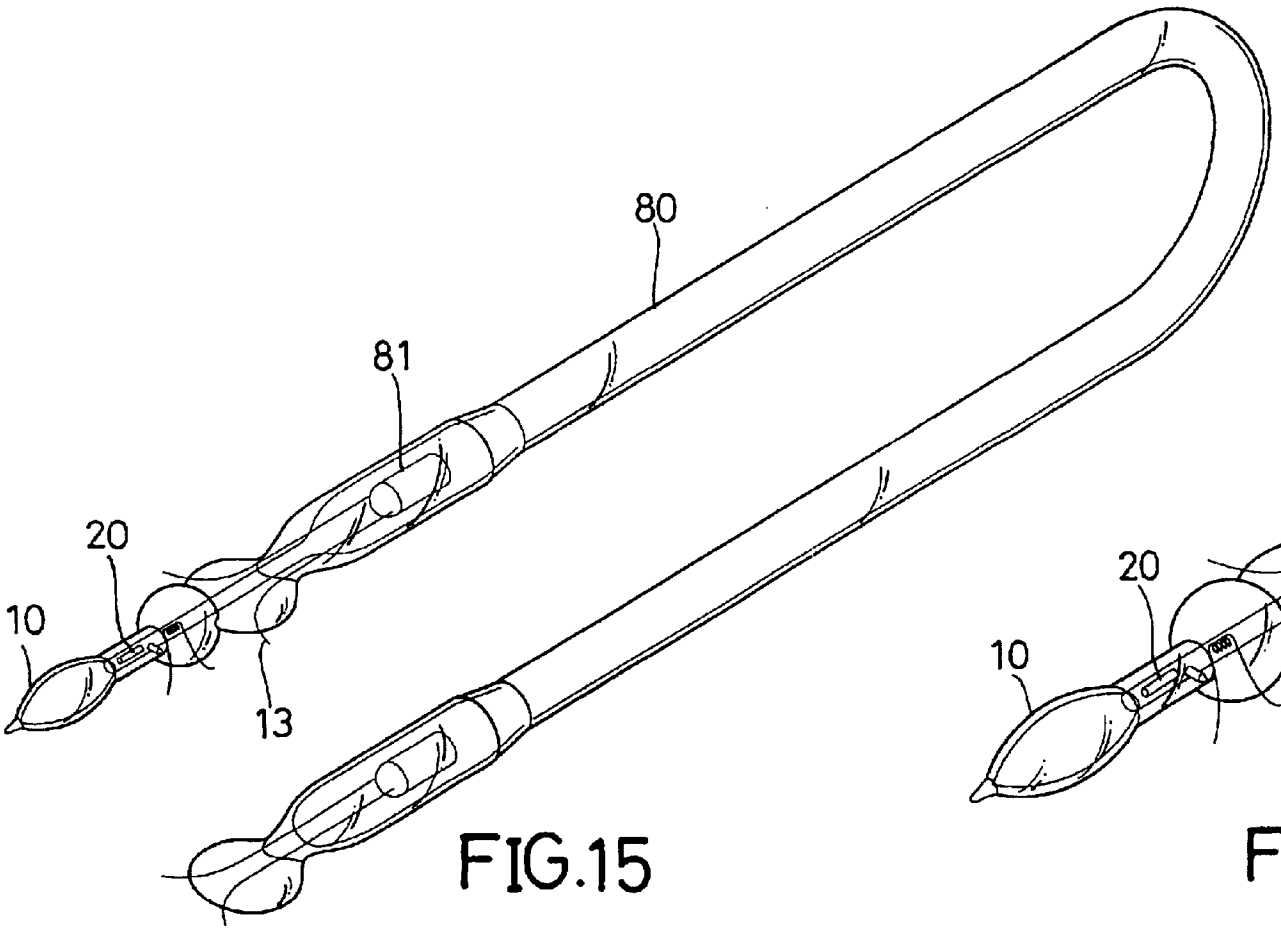
FIG. 15 is a schematic perspective view showing the connection between the inert gas supplementing device and the fluorescent light.
Figures 17, 18:
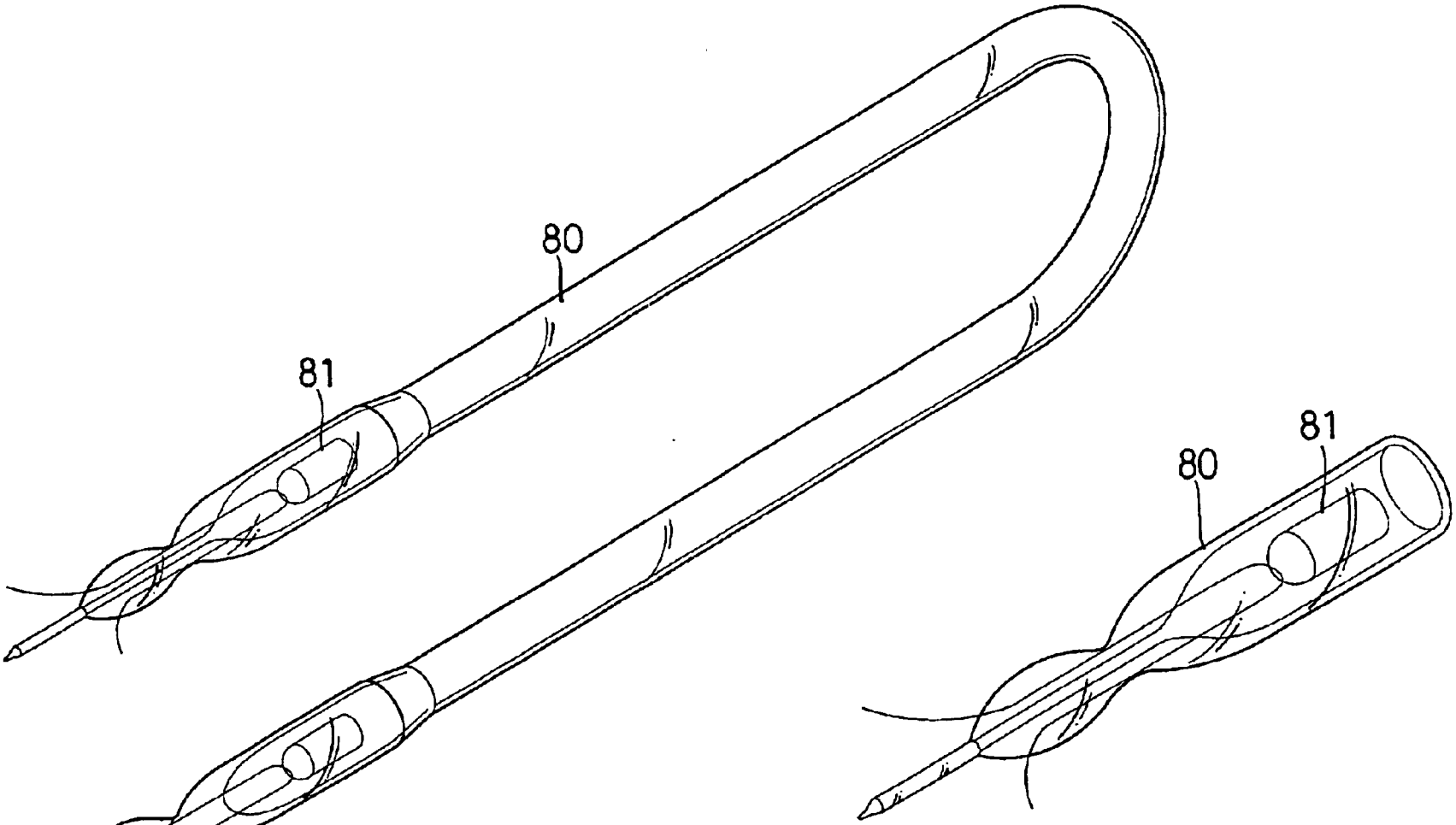
FIG. 17 is a perspective view of a conventional fluorescent light.
FIG. 18 is a perspective view of a portion of the conventional fluorescent light in FIG. 17 closing the ends to enclose the inert gas inside the light tube.

With reference to FIG. 15 and taking FIG. 1 and the conventional fluorescent light (80) in FIG. 17 for reference, it is noted that the second end (13) of the tube (10) of the inert gas supplementing device of the present invention is securely connected to a distal end of the fluorescent light (80), such that when the quantity of the inert gas inside the fluorescent light (80) is decreased due to the sputtering effect, the inert gas in the first end (12) which is sealed after fills with a specified inert gas is able to flow into the fluorescent light (80).

Figure 16:
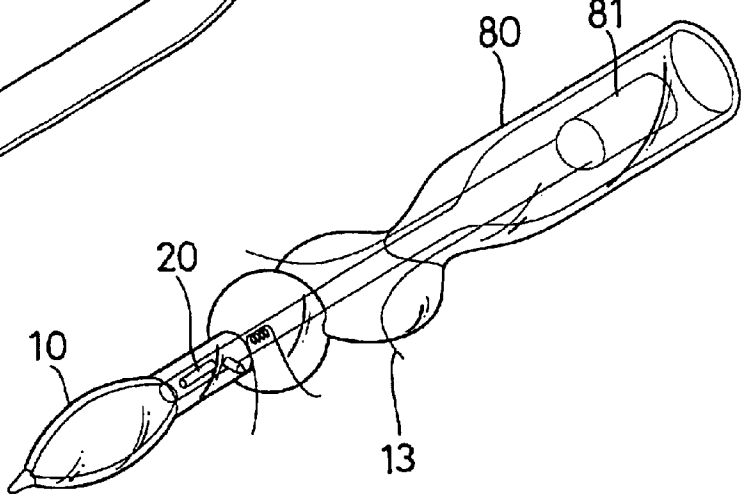
FIG. 16 is a schematic view showing the addition of the inert gas supplementing device of the present invention to the fluorescent light.

With reference to FIG. 16, when combining the inert gas supplementing device of the present invention with the conventional fluorescent light, the tube (10) of the device is first fused to securely combine with the tube of the conventional fluorescent light (80). Then, after the conventional fluorescent light (80) is vacuumed on a side of the conventional light tube and filled with the inert gas, the tube (10) is vacuumed and then filled with the inert gas. After the pressure of the inert gas reaches 1 atm in the tube (10), the tube (10) is sealed, such that the inert gas in the device of the present invention is able to flow through the porous stop (20) to supplement the loss of the inert gas in the conventional light (80).

It is noted that a luminosity sensor is able to be added to the periphery of the fluorescent light to detect the luminosity of the fluorescent light such that when the luminosity of the fluorescent light dims due to the decrease of the inert gas in the fluorescent light, the luminosity sensor is able to send a signal to the heating device (60) to accelerate the seeping velocity of the inert gas to the fluorescent light. A vacuum sensor may also be provided inside the fluorescent light to detect the vacuum status of the fluorescent light. Therefore, when the vacuum status in the fluorescent light is detected to be over a standard quantity, the vacuum sensor sends a signal to the heating device (60) to increase the inert gas supplementing process to the fluorescent light.

It may be noted that the fluorescent light and the inert gas supplementing device of the present invention need not necessarily be manufactured at the same site because the inert gas supplementing device has a heat expansion coefficient the same as that of the light tube of the fluorescent light and so the inert gas supplementing device may fit perfectly to the fluorescent light depending on the structure of the fluorescent light.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inert gas supplementing device for a fluorescent light, the inert gas supplementing device comprising:

a tube having a closed end and an open end adapted to communicate with a light tube of the fluorescent light;

a porous stop received in the tube in an air-tight manner; and an inert gas received in an area enclosed by the closed end of the tube and the porous stop, whereby the inert gas is able to seep through the porous stop and flow to the fluorescent light to supplement inert gas in the fluorescent light.

2. The inert gas supplementing device as claimed in claim 1, wherein the tube has a shoulder integrally formed on an inner periphery of the tube and the porous stop is received in the shoulder, the shoulder has a length shorter than that of the porous stop so that adjusting the length of the shoulder is able to adjust seeping velocity of the inert gas to the fluorescent light.

3. The inert gas supplementing device as claimed in claim 1, wherein the porous stop has a passage defined through the porous stop to receive therein a stop, the stop has a length shorter than that of the porous stop, such that adjusting the length of the stop is able to adjust seeping velocity of the inert gas from the closed end to the open end.

4. The inert gas supplementing device as claimed in claim 3 further comprising a plug sandwiched by an inner periphery of the tube and the porous stop so that a distance between the plug and the stop is defined, whereby adjusting the distance between the plug and the stop is able to adjust seeping velocity of the inert gas from the closed end to the open end.

5. The inert gas supplementing device as claimed in claim 1, wherein the tube has a second porous stop received in the tube in an air-tight manner and spatially parted from the porous stop.

6. The inert gas supplementing device as claimed in claim 3, wherein the tube has a second porous stop received in the tube in an air-tight manner and spatially parted from the porous stop.

7. The inert gas supplementing device as claimed in claim 4, wherein the tube has a second porous stop received in the tube in an air-tight manner and spatially parted from the porous stop.

8. The inert gas supplementing device as claimed in claim 1 further comprising a heating device mounted around an outer periphery of the tube so as to increase pressure of the inert gas in the closed end.

9. The inert gas supplementing device as claimed in claim 7 further comprising a heating device mounted around an outer periphery of the tube so as to increase pressure of the inert gas in the closed end.

* * * * *